US005640781A

United States Patent [19]

Carson

[11] Patent Number: 5,640,781

[45] Date of Patent: Jun. 24, 1997

[54] APPARATUS FOR STYLING NATURAL AND ARTIFICIAL HAIR

[76] Inventor: Gary Patrick Carson, 2660 Marilee La., Apt. A-61, Houston, Tex. 77057

[21] Appl. No.: 385,307

[22] Filed: Feb. 7, 1995

[51] Int. Cl.[6] ..... A45D 1/00; F24H 3/02

[52] U.S. Cl. ..... 34/97; 132/279; 132/269; 392/363; 392/381

[58] Field of Search ..... 34/96, 97, 98, 34/283; 132/119.1, 120, 229, 269, 271; 392/380, 381, 382, 363, 364

[56] References Cited

U.S. PATENT DOCUMENTS

| | | | |
|---|---|---|---|
| 1,890,047 | 12/1932 | Cox | 132/229 |
| 3,265,075 | 8/1966 | Edman et al. | 34/97 X |
| 3,476,121 | 11/1969 | Foley | 132/229 |
| 3,872,607 | 3/1975 | Klaus | 34/98 X |
| 3,911,934 | 10/1975 | Helbling | 392/380 X |
| 4,242,810 | 1/1981 | Blanco | 34/98 |
| 4,409,998 | 10/1983 | Bauer | 34/96 X |
| 5,103,577 | 4/1992 | Michaels et al. | 34/97 X |
| 5,386,644 | 2/1995 | Lawall et al. | 34/96 X |

FOREIGN PATENT DOCUMENTS

| | | | |
|---|---|---|---|
| 1457415 | 1/1969 | Germany | 34/97 |

*Primary Examiner*—Hoang Nguyen
*Attorney, Agent, or Firm*—Ezra L. Schacht

[57] ABSTRACT

A ceiling or wall mounted hair styling unit supplies a user controlled volume of hot and cold air through an extendable, hollow-armed delivery tube to an adjustable nozzle leaving the user's hands free to manipulate hair styling tools. The user controls the amount of heat and volume of air with a wireless, remote control contained in the handle of a hair brush or within a foot operated, wireless signaling device, leaving both hands free to maximize artistic styling potential.

11 Claims, 9 Drawing Sheets

APPARATUS FOR STYLING NATURAL AND ARTIFICIAL HAIR

BACKGROUND OF THE INVENTION

The present invention relates to an apparatus for the combining of a mechanically supported hot air blower, hair drying unit with an operator-controlled switch to free hands for the artistic styling of natural and artificial hair by hot forming and cold setting in the styling salon or the home.

In Disclosure Document No. 365727, submitted to the PTO on Nov. 22, 1994 there appears much of the material in this specification.

PRIOR ART

Methods of hair grooming require convenient methods of heating the hair to set the style to a fixed shape as well as simply drying the hair. A skilled hairdresser or stylist uses a cylindrical brush with short bristles projecting radially from the cylinder surface and a hand held heated air blower—the conventional blow dryer. Holding the brush in one hand and the dryer in the other, the stylist wraps or rolls a skein of slightly damp hair around the cylindrical brush and both drys and thermally sets the hair to conform to the curvature of the brush cylinder. In order for the skein of hair to remember its curl, it must be cooled before being unrolled from the brush. This is best accomplished by turning off the heating element contained in the blow dryer while continuing to blow a stream of air at ambient temperature until the skein of hair has set or taken the curl. A "pick" or dull pointed probe with handle is used to embellish the style by lifting curls or by holding and slightly stretching skeins of hair in alternate positions while thermally setting the hair with the blow dryer. The pick is used to divide the skein into the correct amount, in that too much hair on the brush is not effective. In order to accomplish these additional acts, with the current method, the stylist must transfer the blow dryer to the same hand as the cylindrical brush, making the stylist wish for a third hand. The present invention answers these needs by providing support to the blow dryer by extensible means from an overhead fixture or movable track secured to the ceiling or to the upper area of a wall or partition. Moving the apparatus from side to side on the aerial track accommodates both left and right handed individuals. An operator-controlled, wireless and foot-operated switch first turns on the heater to apply heated air to the skein of hair in order to plastically stretch the hair around a molding form. Next, the operator controlled switch turns off the heater, letting the air blower deliver cool, ambient air to the skein of hair to force the hair to set into the desired formed position. This wireless, foot operated switch can emit a coded radio, ultrasonic or optical signal to control the operation of the blow dryer heater. Given the state of present technology, a set of remote commands to operate the heater and air blower at discretely variable rates with the press of a foot operated button is easily accomplished in a small, rugged battery operated foot switch assembly.

The stylist's client might see his or her stylist monthly or bimonthly, but generally wash their hair on average once a day and would like to duplicate the stylist's work on a daily basis, without practicing the extensive juggling of blow dryer, brush and pick. The present invention, as envisioned, would have wide application and become a familiar fixture in every modern home. The extensible arm of rectangular or round hollow tubing with pivots and swivels, allow for wide freedom in placement of the air stream from the blow dryer to meet individual needs. The assembly can be mounted on a movable track with the necessary electrical power supplied through sliding, mating, electrical contacts or through an extending and contracting coiled or fan-folded, flat electrical cable within the track housing. The coiled or fan-folded, flat electrical cable may be extended within the hollow telescoping tubing of the arm to the compact, lightweight blow dryer located at the end of the arm. A variable orifice to direct the flow of air may be built into the terminal end of the blow dryer. Other air diffusers used to dry, fluff and otherwise assist in the brushing or combing of hair may be attached to the end of the blow dryer by suitable means. The extensible arm can be pushed upwards out of the way when not in use or even hidden away behind a spring action door in the ceiling or wall much like attic stairs. A wireless remote, detached heater and air blower control device contained within the handle of a styling brush or within a small enclosure with switches conveniently operated by foot can be used to first turn on both the heater and air blower, then, upon actuation of one of the switches, toggle the heater on to heat the skein of hair to the point of plastic deformation and off to cool the skein of hair quickly to ambient temperature to set the hair.

For convenient and portable use, one embodiment of the invention hangs the body of the apparatus with a hook-like clip or clamp over the top of a door. If a thin, sheet-metal hanger is used the door can be closed while the unit is in use. This sheet-metal hanger may fold up next to the housing of the blow dryer when not in use or easily detach from the blow dryer for hand held use. Another method of suspending the body of the unit is by means of a vacuum clamp of the "suction cup" variety with a set and release lever for easy application to the face of a glass mirror or other smooth surface. A three inch diameter vacuum clamp can support nearly 100 pounds.

In another embodiment of the invention, the blower and heater units are mounted within the ceiling or wall mounted fixture with the hollow extensible arm serving as the delivery means for the air. An adjustable orifice nozzle terminates the arm to direct the air at the skein of hair. Noise reduction, closer proximity to the wired electrical supply and reduction of weight and strength requirements in the articulated arm are advantages in mounting the air blower and heater within a separate wall or ceiling mounted fixture. This articulated air delivery arm can be made from light aluminum alloy and anodized or painted to match various decors. Temperature resistant plastics can be used for less expensive manufacture. Double walled, foam or fiberglass filled, insulated, temperature resistant tubing and fittings prevent the possibility of painful contact with any hot exposed portion of the assembly. The ability to stow the arm in an elevated position is an added safety factor in settings with children who might be tempted to use the invention as a swing. A break-away section in the arm can be added as an additional safety constraint in similar settings. The apparatus may be built into a cupboard or recessed closet for storage and slide out along the track for use when needed.

One embodiment of the apparatus relies on hollow telescoping sections or rigid tubing for the delivery of heated air. Hollow ball-and-socket or hollow, hinged fittings at the joints of the articulated arms allow a free flow of air through the telescoping rigid tubing. The sections of tubing may telescope to extend from the wall or ceiling for the seated or wheelchair bound client and yet pack compactly against the wall or ceiling or within a recessed cavity in the wall or ceiling. The assembly may be mechanically supported and supplied with electrical power through sliding contacts while being moved along a mounted track within an elongated enclosure. Enclosures for recessed or surface mounting may be similar to those of lighting fixtures and may include light sources.

DETAILED DESCRIPTION OF THE DRAWINGS

Figure 1:
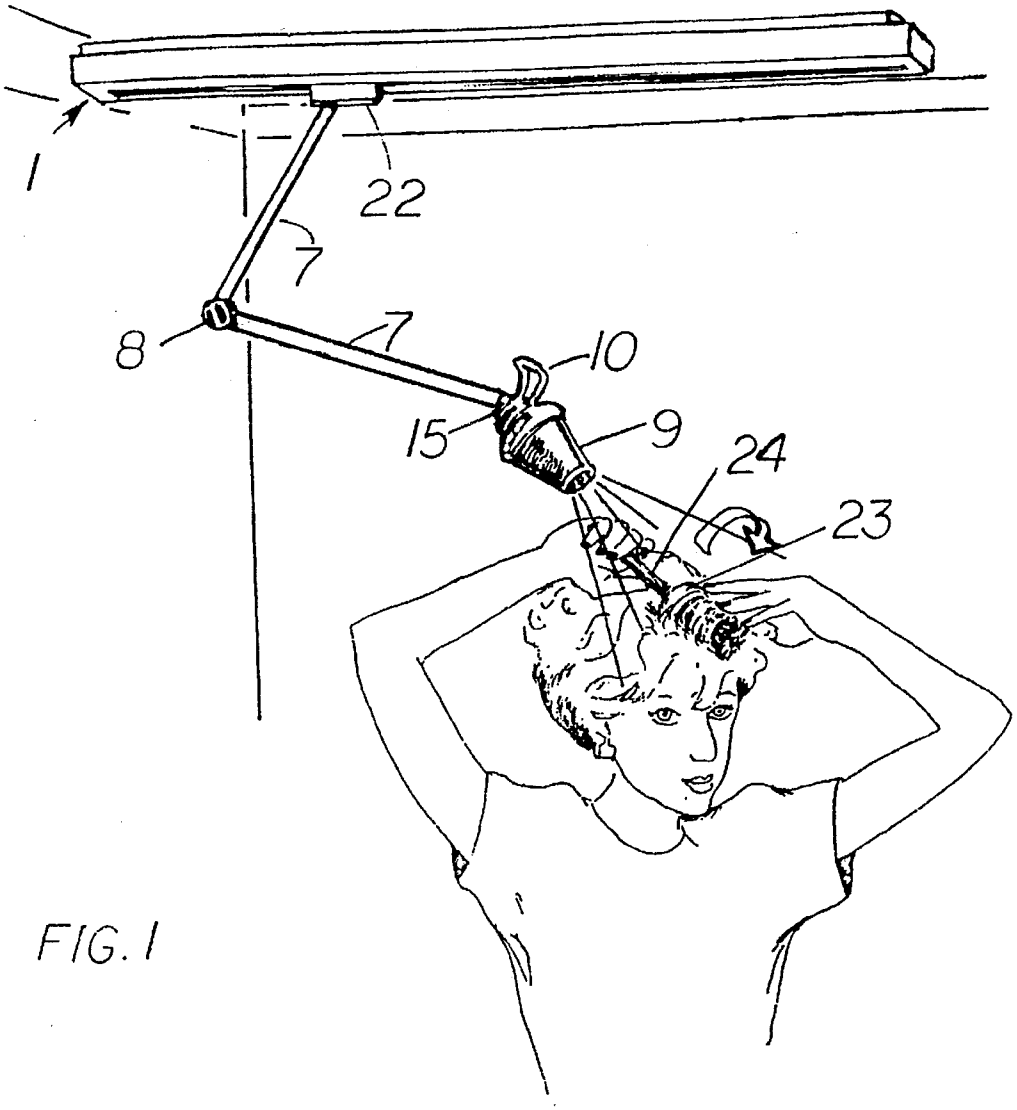
FIG. 1 shows a view of the overhead apparatus in use with arm extended.

FIG. 1 shows an overhead fixture 1 with track and slide 22 having a suspended arm 7 with articulated joint means 8 and articulated swivel 15. The handle 10 lets the user easily direct the nozzle 9 toward the proper space above the user's head. Foot operated controls (not shown in FIG. 1) set the rate of air flow and the temperature of the air in discrete or continuous levels by means of radio or infrared signals sent to a receiver and controller located in the overhead fixture 1. The light weight air blower and heating mechanism can be located in the nozzle 9 and supplied by electrical means through the hollow extensible arms 7. In an alternative embodiment, the enclosure 1 may house the air blower, heating element, receiver and controller, as well as associated electrical wiring, allowing the extendable hollow arm assembly and nozzle solely to carry and direct the air flow. The track fixture assembly may be used to support and supply electrical power to multiple heated air dryer assemblies, as well as lighting sources. The track fixture may contain a remotely operated central control means to set individual lighting levels and air heat and volume levels.

The method described in this invention and illustrated in FIGS. 1 through 5, indicate the maximum utility in using this approach to quick and varied hair styling by professionals and clients alike.

Figure 2:
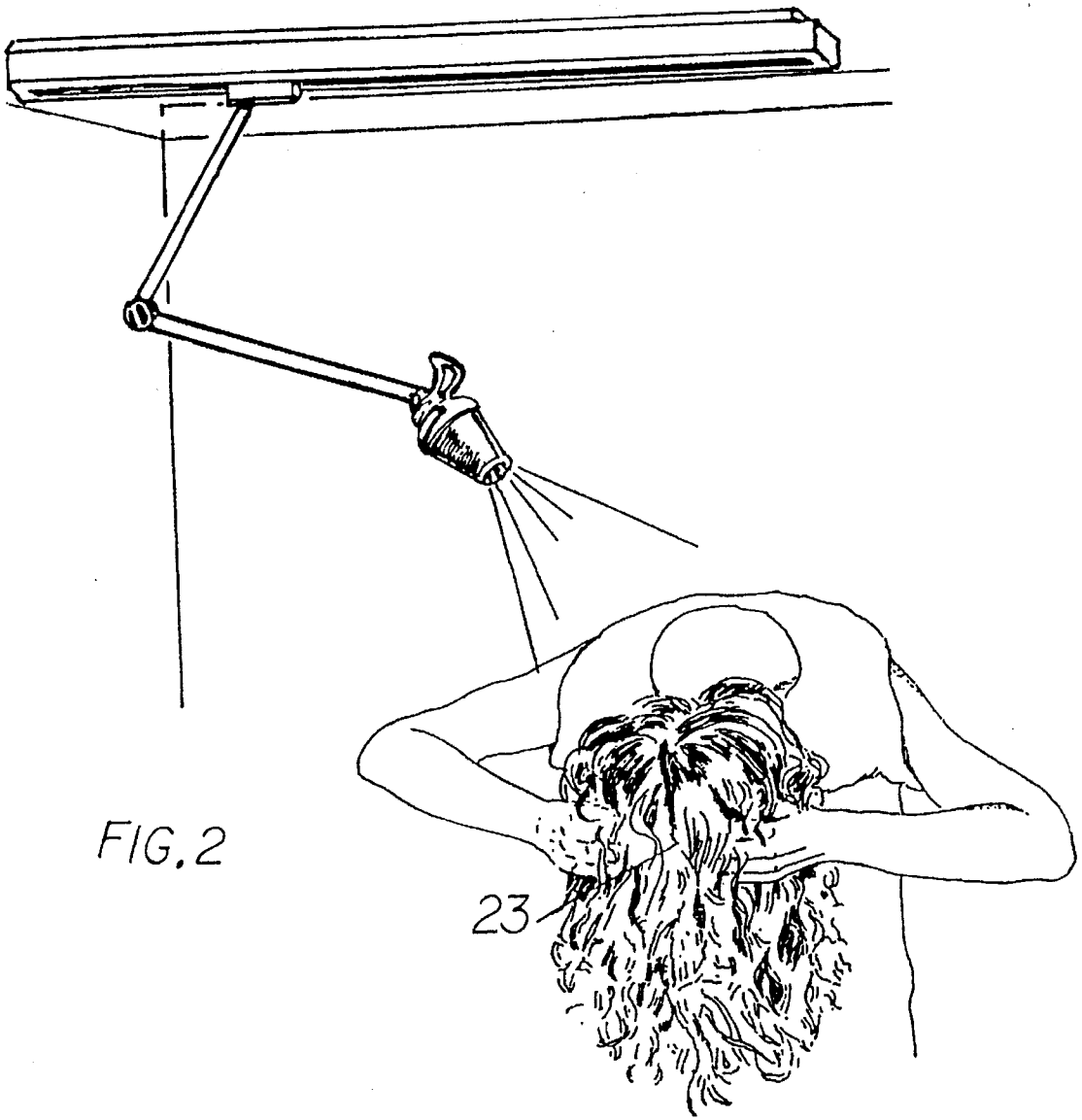
FIG. 2 is a perspective view of overhead apparatus in use to dry hair.

FIG. 2 shows a method of using the invention to dry and fluff the skein of hair 23, using both hands symmetrically, an act not possible with a hand held blow dryer.

Figure 3:
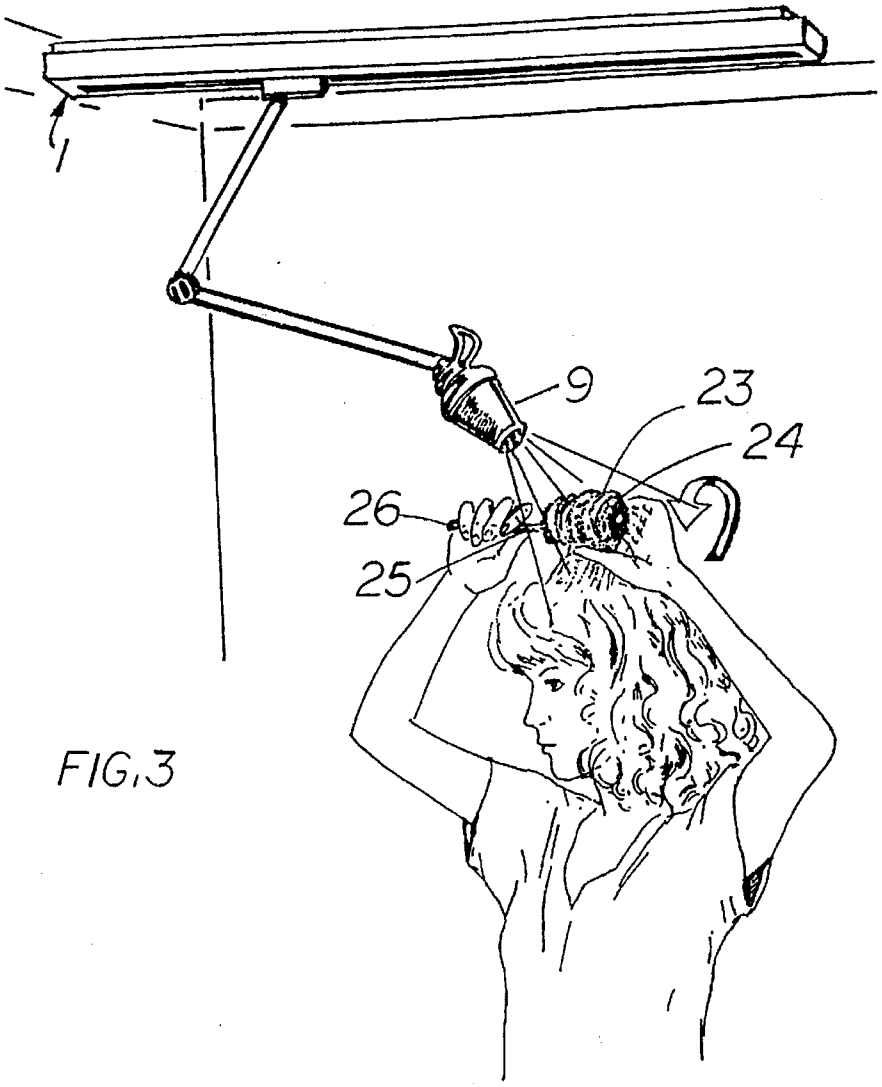
FIG. 3 is a view of apparatus in use to set a curl in a skein of hair around a cylindrical brush.

FIG. 3 illustrates the invention in use to style a skein of hair 23 around a cylindrical brush 24 using the heat-to-form and cool-to-set method. Styling potential is maximized by the free use of both hands. Operator-controlled, thumb activated switches 25 conveniently command the flow and temperature of air from adjustable nozzle 9 by means of wireless control elements 26 located in the cylindrical brush 24.

Figure 4:
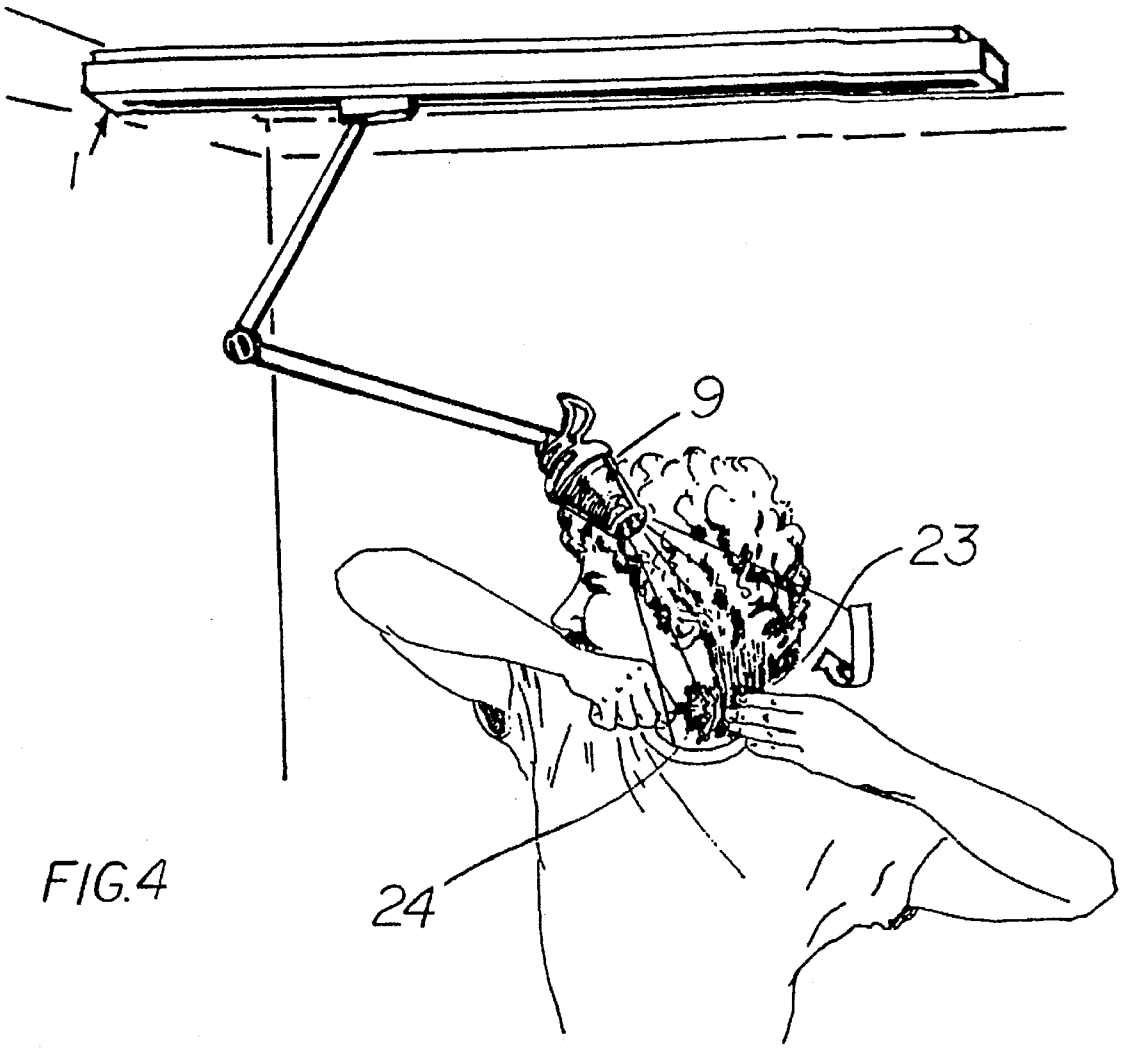
FIG. 4 is a view of the apparatus being used to straighten curly hair.

FIG. 4 shows the invention in use to straighten curly hair by stretching the skein of hair 23 under a flow of heated air from adjustable nozzle 9 and then cooling the skein of hair 23 in the taut, elongated position. This works best with the use of both hands to manipulate cylindrical brush 24.

Figure 5:
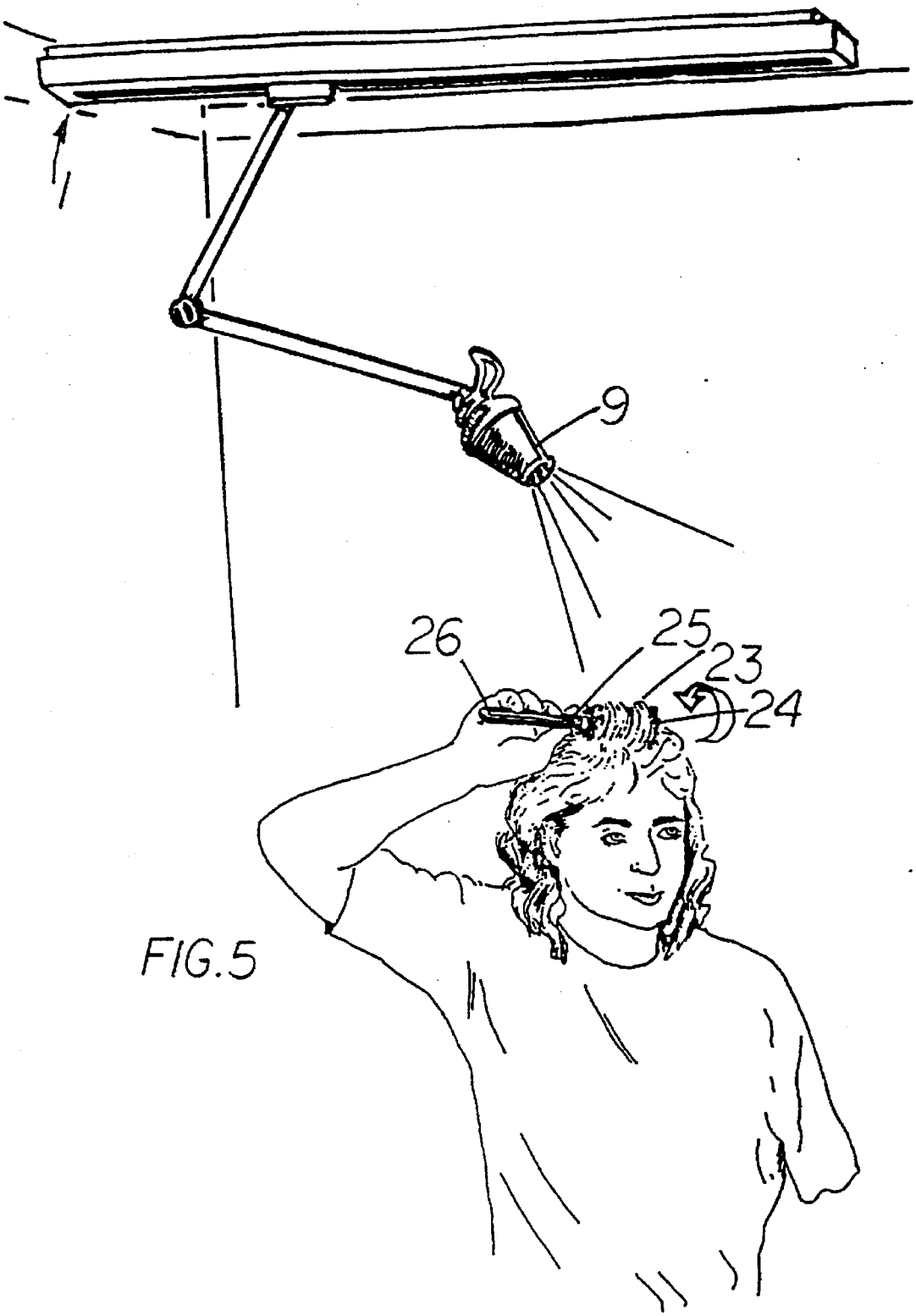
FIG. 5 shows the apparatus in use by a physically challenged person.

In FIG. 5 the invention portrays a method of styling useful to the physically impaired, a task all but impossible with the hand held blow dryer. Overhead housing 1 supplies thermally controlled air through adjustable nozzle 9. A skein of hair 23 is formed about the brush 24 with only one arm in use. Operator-controlled thumb switches 25 command the flow and temperature of the air by means of wireless control elements 26 located within cylindrical brush 24.

Figure 6:
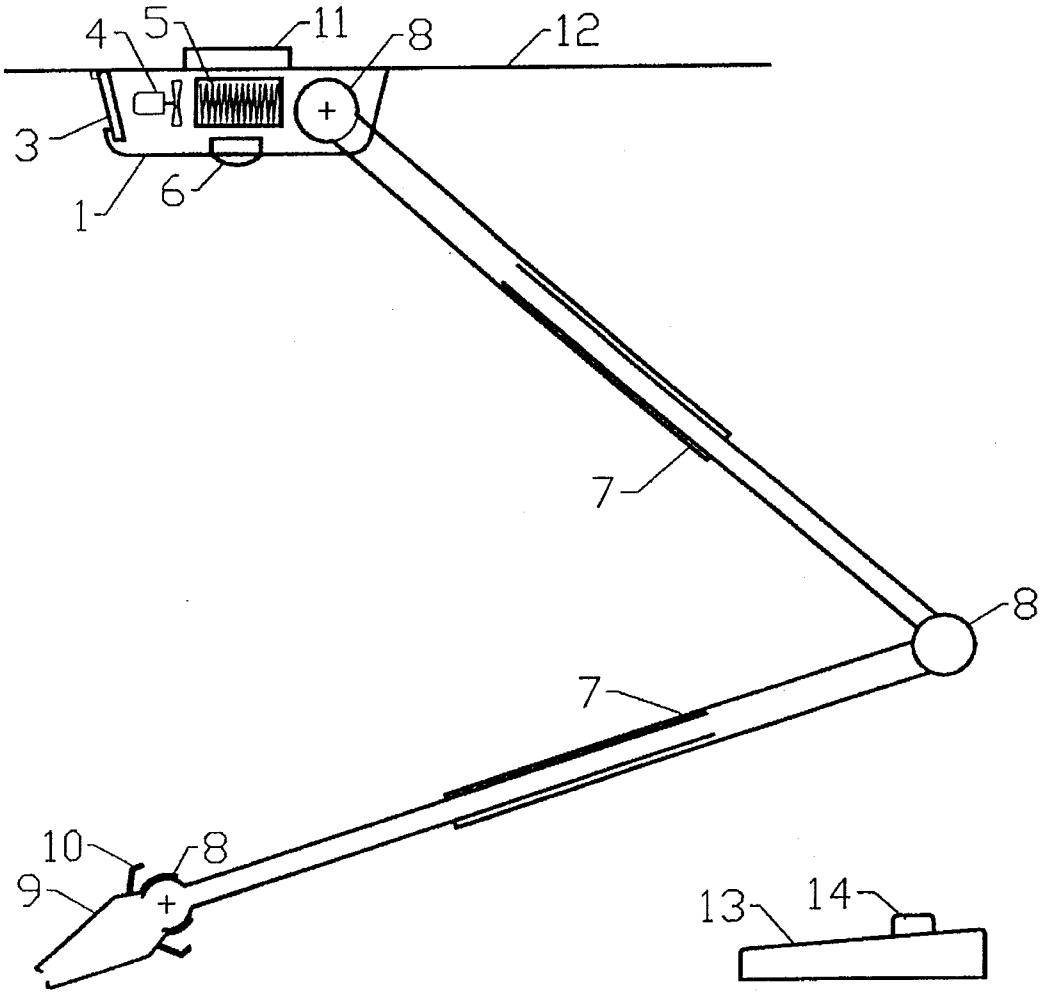
FIG. 6 is an elevated cut away view of the internal elements of the apparatus.

In the embodiment of the invention detailed in FIG. 6 the apparatus has a shell like, airtight enclosure 1 with a replaceable or cleanable air inlet filter 3, a variable speed electric motor with air impeller 4 and heating element 5. The heating element can be made from a coil of heating wire on a heatproof structure of ceramic or mica. Alternately, the heating element may be a positive temperature coefficient (PTC) ceramic resistance element in the shape of perforated plate that increases in electrical resistance when heated by an electrical current and will rise to a set temperature for a given voltage impressed across the PTC element, regardless of the volume of air that flows through it. Thus the PTC element maintains a variable air volume at the same temperature for a given ceramic formulation and voltage across the element.

The air impeller in combination with the heating element are designed to provide hot or cool ambient forced air through extendable tubes 7 with articulated hollow joints 8 to the adjustable thermally insulated nozzle 9.

In FIG. 6, the air is directed out to the hair being styled through nozzle assembly 9. The handles 10 allows the extendable tubing and thermally insulated nozzle to be positioned without burning the hand while redirecting the air flow. The extendable tubing 7 and articulated joints 8 are manually adjustable, yet hold rigidly in place when released.

The flow and temperature controller, along with the "wireless" infrared, ultrasonic or radio frequency receiver are located in assembly 6 in the enclosure housing 1.

The housing 1, shown in FIG. 6, is mounted to a suitably supported electrical outlet box 11 mounted in wall or ceiling 12. Foot operated, battery powered remote transmitter 13 has at least one control button 14 to turn the flow of air on and off, as well as a remote control for the heating element 5.

The stylist presses at least one foot operated switch 14 in the remote control assembly 13 containing a low power, short range, radio frequency, ultrasonic or infrared light remote transmitter to control the heating and fan mechanism as a wireless link to a radio frequency receiver, ultrasonic receptor or infrared light detector in control element 6. The transmitter and receiver can be encoded with a unique sequence of pulses of radio frequency, ultrasonic or infrared bursts to insure that false motor and heater starts do not occur. In addition, differing transmitted codes can set maximum air temperature and air velocity to meet individual needs. These can either be preset levels within control assembly 13 or levels determined by the number or duration or presses upon at least one of the switches 14.

Figure 7:
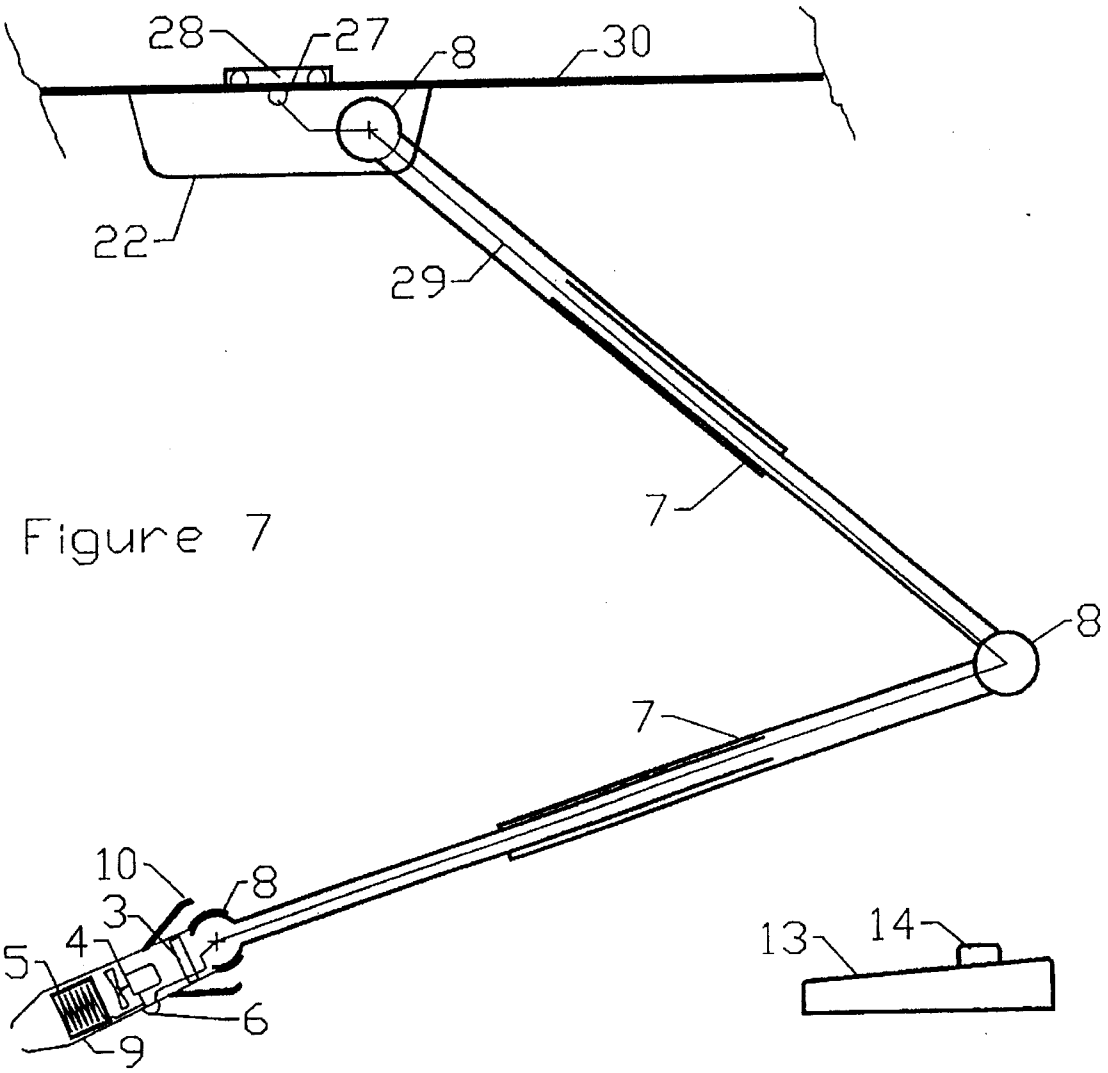
FIG. 7 is an elevated cut away view of a trolley mounted apparatus with air moving and heating elements at terminal end.

In FIG. 7, an alternate embodiment of the apparatus, the control of the air blower 4 and coiled heating element 5 utilizes at least one remote control receiver element 6 located in or near the nozzle 9. Removable air filter element 3 is positioned up stream of the air blower 4. Air input vents, not shown, are located up stream of the air filter 3. The remote control receiver 6 containing a means to alter the volume and temperature of the air flow by changing or interrupting the electrical power to air blower 4 and heating element 5, is signaled by the remote control transmitter 13 with at least one switch 14 to remotely control the temperature and volume of air. Electrical power for the air blower 4 and the heating element 5 is delivered by means of a coiled or flat, fan-folded cable 29 which extend or contract to accommodate the changes in length of telescoping tubing 7 and swivel joints 8. Handle 10 allows the apparatus to be easily moved to a new fixed position and attitude.

The insulated housing 22 contains a trolley assembly 28 and is free to slide or roll along track 30 which supplies both an sliding set of electrical connections 27 and mechanical support.

Figure 8:
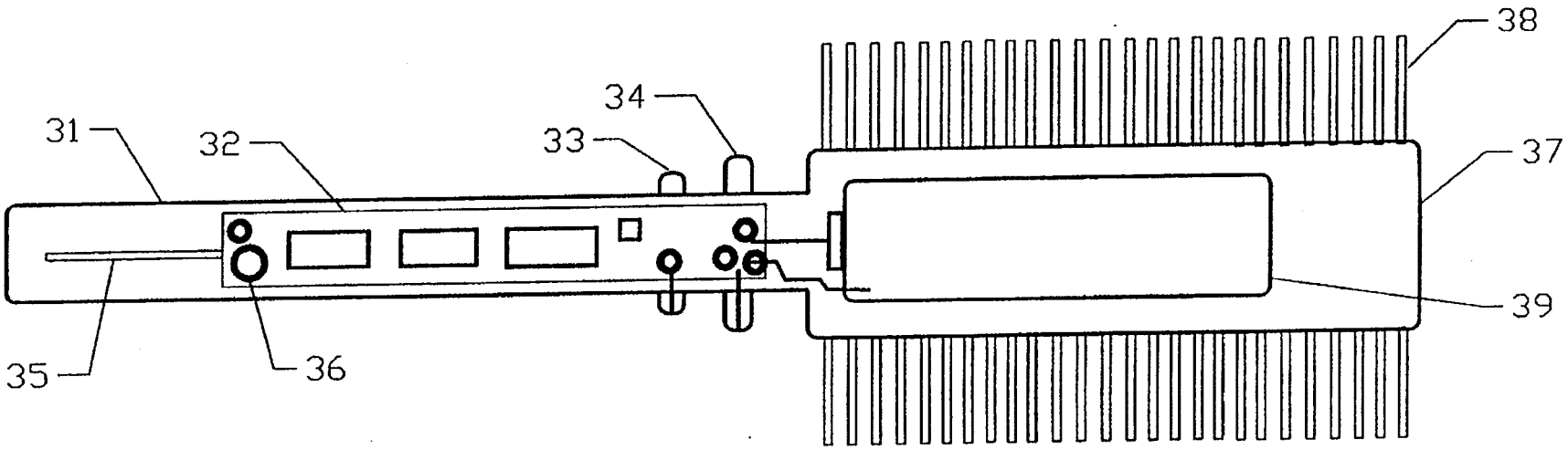
FIG. 8 is a cross sectional view of the hand held styling device containing within a wireless remote control.

FIG. 8 relates another convenient and useful place for the miniature battery operated controller, within the handle 31 of the curling brush. Several strategically placed thumb or finger controlled buttons 33 and 34 on the handle 31 may uniquely control the air temperature and air speed levels. Control by touch switches 33 and 34 in the form of rings around the circumference of the brush handle 31 allow for access to these switches without respect to brush orientation while rolling skein of hair about the brush. The handle 31 of the styling device may be detachable from the shaping head 37 to accommodate a variety of different forms to shape the size and contour of the skein of hair. Bristles 38 are attached to the shaping head 37.

Present technology allows for a low power radio frequency transmitter 32 with antenna 35 to occupy less than a few cubic centimeters of space and still issue a series of encoded commands to a nearby receiver. Alternately, a wireless infrared emitter 36 may send multiple distinct commands through an infrared transparent window in the handle 31 to a nearby infrared receiver. Circuitry to drive a small ultrasonic transmitter may be included. Battery 39 can provide power on demand to insure long life and minimal energy usage.

Figure 9A:
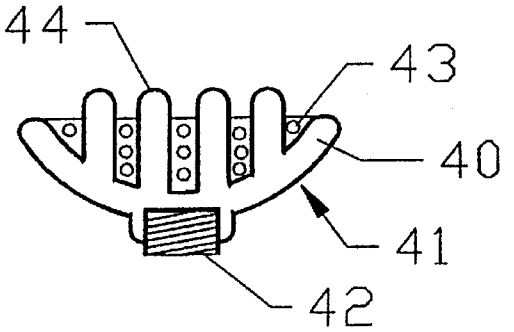
FIG. 9 is a cross sectional view of the attachable air diffuser and the hemispherical air diffusion hood.
Figure 9:
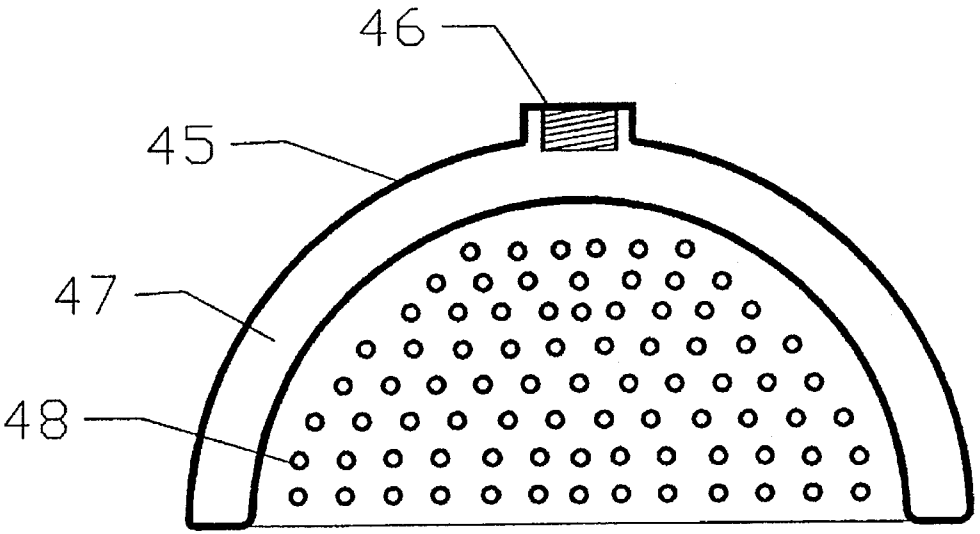

FIG. 9 shows a cross sectional view of two attachments that can be fixed to the end of the air blower nozzle to broadly diffuse the flow of air. The air diffuser 41 has a hollow internal volume 40 with multiple diffusion holes 43 and extended molded hollow fingers 44 to comb out and dry a long skein of hair. This diffuser is most useful in providing a wider flow of slowly moving warm air to dry curled hair without disturbance. The fingers 44 serve to separate individual strands. A quick twist, quarter turn, threaded coupling 42 or snap on type coupling means may be used to attach the air diffuser to the blow dryer nozzle.

The hemispherical, double-walled dome dryer 45 has multiple air diffusion holes 48 connected through the internal aspect of the dome to the hollow internal volume 47. A quick twist, quarter turn, threaded coupling 46 is illustrative of a convenient means to attach this air diffusion dome to the nozzle of the blow dryer. The internal aspect of the dome is large enough to allow for a full head of hair with large rollers, such as the Velcro (Tm) type popular today. By leaving the hands free, other tasks, such as, the application of makeup, may be done.

This apparatus and method of remotely operating a controlled volume of air for heating and cooling can be employed to the forming and modelling of wigs and other hair replacements upon the head or upon a stand and whether made of natural or artificial fibrous strands or filamentary structures.

Whereas the drawings and descriptions shown herein are illustrative of the method and apparatus for combining of mechanically supported hot air blower hair drying unit with a wireless, foot operated control switch, these and other variations of the present invention may be made which fall within the scope of the appended claims even though such variations were not related above.

The accompanying drawings referred to herein are illustrative of the invention but not restrictive thereto, and, together with the description, serve to explain the principles of the invention.

What is claimed is:

1. An operator-controlled apparatus having remote means for adjustably directing a flow of air of variable temperature and volume against at least a portion of a subject's hair, the apparatus providing alternately heated air to thermally form and non-heated air to cold set to a fixed shape said portion of subject's hair, the apparatus comprising:

a. remote means of a wireless type;

b. a housing having mounting means to a supporting structure;

c. the housing having therein air blowing and air heating means;

d. said housing further having connected thereto an extensible hollow arm having articulating means; and e. said operator-controlled apparatus, in response to signals from said remote means, varying temperature and volume of said air passing through said articulating arm means, providing alternately heated and non-heated air.

2. An operator-controlled apparatus as recited in claim 1, in which the remote means are contained within a wired foot-switch means.

3. An operator-controlled apparatus as recited in claim 1, in which the remote means are contained within a hand-held, styling implement.

4. An operator-controlled apparatus as recited in claim 1, in which said housing means are supported over the top of a door by suspending means.

5. An operator-controlled apparatus as recited in claim 1, in which said housing means are supported by means of a vacuum clamp.

6. An operator-controlled apparatus as recited in claim 1, in which replaceable air filtering means is placed ahead of the air flow path within the housing.

7. An operator controlled apparatus, as recited in claim 1, having means for adjustably directing a stream of air of variable temperature and volume against at least a portion of a subject's hair, the apparatus having mounting and enclosing box-like means, said apparatus having lighting means in combination with said box-like means.

8. An operator controlled apparatus of a type having extensible and retractable means for adjustable support, the apparatus directing a stream of air of variable temperature and volume against at least a portion of a subject's hair, said apparatus having enclosing airtight boxlike means, the boxlike means containing:

a. a variable speed air moving device;

b. a thermal element capable of heating said stream of air; and c. a positionally adjustable air-directing terminal nozzle attached to said housing to bring said air stream in proximity to said subject's hair to free the hands of the operator for artistic positioning and permanently forming of at least a portion of said subject's hair, the improvement comprising:

d. a remote wireless controller, said controller having a controlling signal transmitter, said transmitter being contained within a hand-held styling implement.

9. An operator-controlled apparatus as recited in claim 8, in which replaceable air filtering means are placed ahead of the air flow path within the housing.

10. An operator-controlled apparatus, as recited in claim 8, having attachment means at terminal end of air blower nozzle for an air diffuser.

11. An operator-controlled apparatus, as recited in claim 8, having movable track means to position and supply power to said apparatus.

* * * * *